US006890237B2

(12) United States Patent
Nishiki et al.

(10) Patent No.: US 6,890,237 B2
(45) Date of Patent: May 10, 2005

(54) SHADOW MASK ASSEMBLY MANUFACTURING METHOD AND CATHODE RAY TUBE MANUFACTURING METHOD

(75) Inventors: Naomi Nishiki, Kyoto-fu (JP); Tosinobu Yokoyama, Osaka-fu (JP); Yuji Uesugi, Osaka-fu (JP); Kiyotaka Ihara, Osaka-fu (JP); Ayumu Takakuwa, Hyogo-ken (JP); Kiyohito Miwa, Nara-ken (JP); Yoshikazu Iwai, Osaka-fu (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 307 days.

(21) Appl. No.: 09/742,390

(22) Filed: Dec. 22, 2000

(65) Prior Publication Data

US 2001/0018309 A1 Aug. 30, 2001

(30) Foreign Application Priority Data

Dec. 27, 1999 (JP) ..... 11-369829

(51) Int. Cl.[7] ..... H01J 9/14
(52) U.S. Cl. ..... 445/30; 313/408
(58) Field of Search ..... 445/30, 36–37, 445/47, 23; 313/408

(56) References Cited

U.S. PATENT DOCUMENTS 4,636,683 A * 1/1987 Tokita et al. ..... 313/403
4,828,523 A * 5/1989 Fendley et al. ..... 445/30
4,964,828 A * 10/1990 Patt et al. ..... 445/4
5,274,301 A * 12/1993 Takahashi et al. ..... 313/406
5,634,838 A 6/1997 Egami et al.
5,702,280 A * 12/1997 Horiuchi ..... 445/23
5,982,085 A * 11/1999 Lakshmanan et al. ..... 313/407
6,025,676 A * 2/2000 Ohama et al. ..... 313/477 R
6,097,142 A * 8/2000 Ko ..... 313/402
6,106,353 A * 8/2000 Kimura et al. ..... 445/30
6,208,067 B1 * 3/2001 Nakagawa et al. ..... 313/461
6,283,814 B1 * 9/2001 Lee ..... 445/30
6,642,642 B1 * 11/2003 Watanabe et al. ..... 313/402

FOREIGN PATENT DOCUMENTS

| | | |
|---|---|---|
| JP | 08-083563 | 3/1996 |
| JP | 08-167376 | 6/1996 |
| JP | 08-167389 | 6/1996 |
| JP | 09-092145 | 4/1997 |
| JP | 10-188794 | 7/1998 |
| JP | 10-188795 | 7/1998 |
| JP | 11-176345 | 7/1999 |
| JP | 11-185609 | 7/1999 |
| JP | 11-204026 | 7/1999 |

* cited by examiner

*Primary Examiner*—Nimeshkumar D. Patel
*Assistant Examiner*—Dalei Dong
(74) *Attorney, Agent, or Firm*—Wenderoth, Lind & Ponack L.L.P.

(57) ABSTRACT

A method of manufacturing a shadow mask assembly, in which a shadow mask is fastened to a support frame in a tensioned state, includes applying a preliminary tension force with a magnitude of 9.8 to 490 N to the four corners of the shadow mask outwardly aslant with respect to sides of the shadow mask. A main tension force is then applied to each of at least a pair of mutually opposite sides of the shadow mask outwardly perpendicularly to the sides. Thereafter, the shadow mask to which the main tension forces have been applied is fastened to the frame side of the support frame.

18 Claims, 7 Drawing Sheets

SHADOW MASK ASSEMBLY MANUFACTURING METHOD AND CATHODE RAY TUBE MANUFACTURING METHOD

BACKGROUND OF THE INVENTION

The present invention relates to a shadow mask assembly manufacturing method and a cathode ray tube manufacturing method. In particular, the invention relates to a method of manufacturing a shadow mask which is a component of a cathode ray tube utilized for image display in a television receiver or the like. The shadow mask has minute holes through which an electron beam passes, and a support frame supports the shadow mask. The invention relates to a method of manufacturing the cathode ray tube with this shadow mask assembly incorporated therein.

As a television receiver, a flat type television receiver having a flat image display surface, or a flat television receiver is known. In contrast to the conventional television receiver, the image display surface of which has a gently curved convex surface, the flat type television receiver has an almost flat image display surface, which is regarded as being able to display an image with good visibility and little distortion.

The flat type television receiver employs a television tube having a flat image display surface for the purpose of image display. A shadow mask, which is arranged inside the fluorescent screen in the television tube and provided with minute holes through which an electron beam passes, has an almost flat plane.

In the shadow mask, the arrangement of the minute through holes exerts an influence on the positions and shape accuracy of individual bright spots of an image to be drawn by the electron beam. Therefore, the shadow mask must be accurately attached so as to be free from distortion and displacement.

In order to support the shadow mask in a flat plane state, the shadow mask is fixed in a tensioned state to a rectangular support frame by welding or similar means. There is a technique of fixing all four sides of the shadow mask to the support frame. However, it is regarded as more appropriate for supporting the shadow mask in a flat plane state to fix only the mutually opposite longer sides of the shadow mask to the support frame.

Specifically, for example, the unexamined Japanese Patent publication No. 08-167389 (Japanese Patent Application No. 06-309247) discloses that each side is pulled in a direction perpendicular to the side. The unexamined Japanese Patent publication No. 08-83563 (Japanese Patent Application No. 06-216314), the unexamined Japanese Patent publication No. 08-167376 (Japanese Patent Application No. 06-331451), and the unexamined Japanese Patent publication No. 09-92145 (Japanese Patent Application No. 07-271724) disclose that in order to remove wrinkles and slackness and reduce the clamping area, the shorter sides at four corners of a rectangular mask are pulled in four directions perpendicular to the shorter sides, or the mask is pulled in six directions. In other words, in addition to the four directions, center portions of two longer sides are pulled in two directions perpendicular to the longer sides, and then the mask is welded to a frame while the mask is tensioned. The unexamined Japanese Patent publication No. 10-188795 (Japanese Patent Application No. 08-343497), the unexamined Japanese Patent publication No. 10-188794 (Japanese Patent Application No. 08-343496), the unexamined Japanese Patent publication No. 11-185609 (Japanese Patent Application No. 09-358130), and the unexamined Japanese Patent publication No. 11-204026 (Japanese Patent Application No. 10-7850) disclose that in order to remove wrinkles and slackness, the shorter sides at four corners of a rectangular mask are pulled in four directions perpendicular to the shorter sides, and then the mask is welded to a frame while the mask is tensioned.

When fixing the mutually opposite longer sides of the shadow mask to the support frame, a tensioned state is provided by outwardly pulling the mutually opposite longer sides of the shadow mask.

However, there is an issue that the planarity of the shadow mask will be impaired when the shadow mask attached to the support frame is subjected to heat treatment through a baking process, even when the shadow mask is tensioned by sufficient tension forces. Specifically, it is often the case that a shadow mask that has undergone heat treatment comes to have a streak-shaped unevenness that extends in a direction perpendicular to the longer sides. In spite of the effort to increase the tension forces applied to the shadow mask, it has been difficult to completely suppress the occurrence of the aforementioned unevenness.

The object of the present invention is a shadow mask assembly manufacturing method and a cathode ray tube manufacturing method which enables a shadow mask to be attached to a support frame in an accurate planar state without unevenness.

SUMMARY OF THE INVENTION

In order to accomplish the object, the present invention is constructed as follows.

According to a first aspect of the present invention, there is provided a method of manufacturing a shadow mask assembly, in which a shadow mask that has an approximately rectangular sheet-like shape and a perforation region provided with a number of through holes is fastened to a support frame that has an approximately rectangular frame-like shape in a tensioned state of the shadow mask. The method comprises applying a preliminary tension force of 9.8 N to 490 N to each of four corners of the shadow mask outwardly aslant with respect to a side of the shadow mask. A main tension force is applied to each of at least a pair of mutually opposite sides of the shadow mask outwardly perpendicularly to the sides after the preliminary tension force is applied thereto, and the shadow mask is fastened to the sides to which the main tension force has been applied after applying the main tension forces to frame sides of the support frame.

According to a second aspect of the present invention, the shadow mask assembly manufacturing method as defined in the first aspect further comprises applying (before the shadow mask is fastened) compression forces in directions in which a gap between the frame sides is narrowed to a pair of mutually opposite frame sides that belong to the frame sides of the support frame and correspond to the sides of the shadow mask to which the main tension force is applied. The shadow mask is fastened to the frame sides of the support frame in a state in which the compression force has been applied so that the shadow mask is fastened.

According to a third aspect of the present invention, in the shadow mask assembly manufacturing method, the direction in which the preliminary tension force is applied is applied is within a plane of extension in which a plane of the shadow mask is extended from an end portion outwardly in a tangential direction and is inclined at an angle of 15 to 45 degrees with respect to the sides to which the main tension force is applied when the main tension force is applied.

According to a fourth aspect of the present invention, in the shadow mask assembly manufacturing method, when the preliminary tension forces are applied, the preliminary tension forces are applied by clamping the four corners of the shadow mask within a range surrounded by both sides and extension lines of outer peripheral sides of the perforation region.

According to a fifth aspect of the present invention, in the shadow mask assembly manufacturing method, when the preliminary tension forces are applied, the preliminary tension forces are applied by forming at the four corners of the shadow mask three to eight through engagement holes each having a diameter of 3 mm to 8 mm and being located within a range of not less than 3 mm inside a side edge of the shorter side to an extension line of a corresponding peripheral side of the perforation region, and within a range of a side end of the longer side to an extension line of a corresponding peripheral side of the perforation region, and making an engagement member engage the engagement holes.

According to a sixth aspect of the present invention, in the shadow mask assembly manufacturing method, when the main tension forces are applied, each of the main tension forces is applied to a portion of a range of the perforation range of the sides of the shadow mask.

According to a seventh aspect of the present invention, there is provided a cathode ray tube manufacturing method of manufacturing a cathode ray tube provided with a flared tube body, an electron gun attached to a root portion of the tube body, and a front panel that has a fluorescent surface on its internal surface and is attached to a fore end of the tube body. The method comprises manufacturing the shadow mask assembly as explained above in any one of the first through sixth aspects; attaching the shadow mask assembly to the inside of the front panel; and attaching to the tube body the front panel to which the shadow mask assembly has been attached.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE INVENTION

Figure 1:
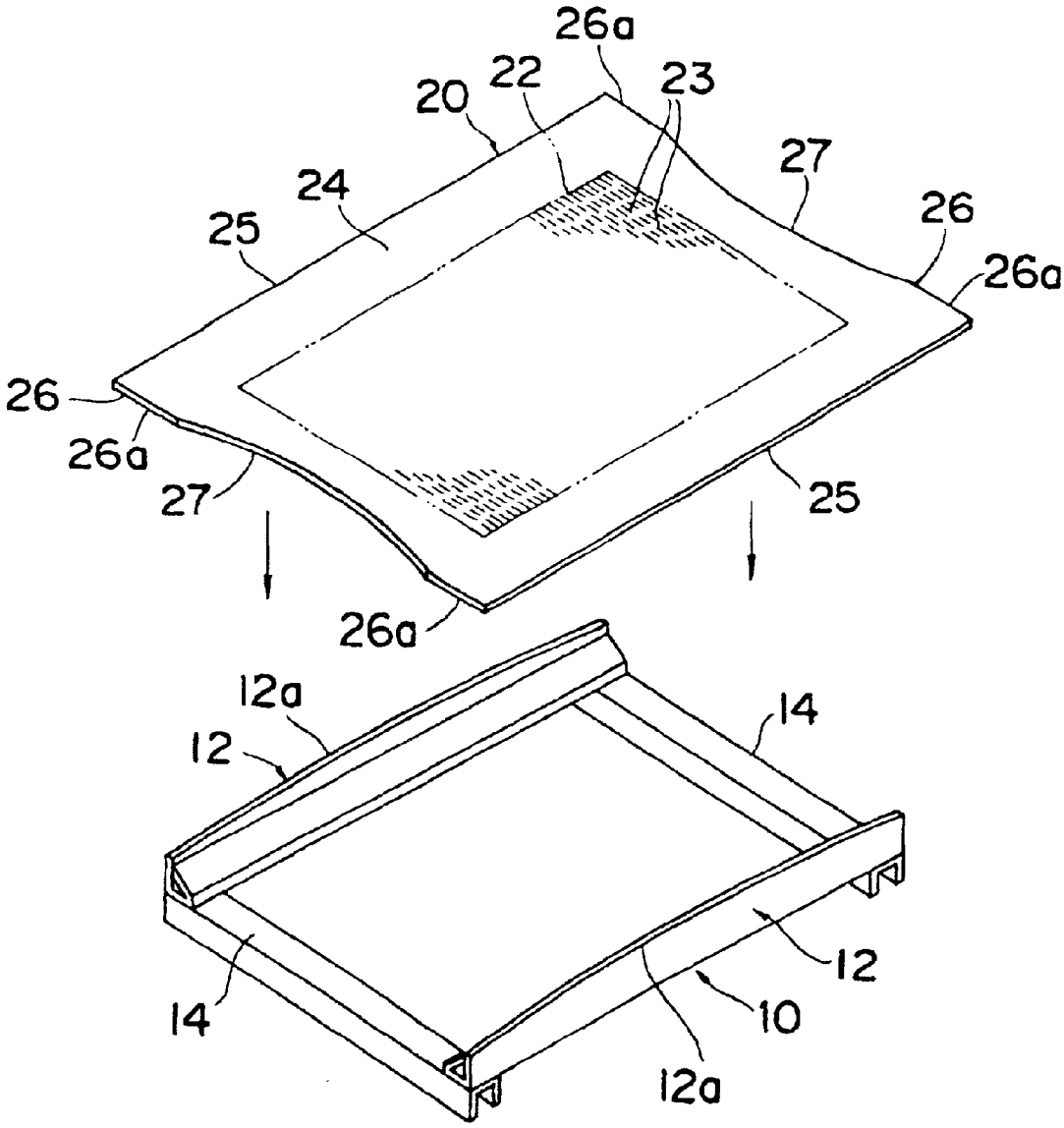
FIG. 1 is a perspective view of a shadow mask and a support frame before assembly in a shadow mask assembly manufacturing method according to an embodiment of the present invention (which is before being assembled)

Before the description of the present invention proceeds, it is to be noted that like parts are designated by like reference numerals throughout the accompanying drawings.

A method of manufacturing a shadow mask assembly according to one embodiment of the present invention, in which a shadow mask that has an approximately rectangular sheet-like shape and a perforation region provided with a number of through holes is fastened to a support frame that has an approximately rectangular frame-like shape in a tensioned state of the shadow mask method, comprises a process applying a preliminary tension force of an strength of 9.8 to 490 N to each of four corners of the shadow mask outwardly aslant with respect to a side of the shadow mask 20. A main tension force is applied to each of at least a pair of mutually opposite sides of the shadow mask outwardly perpendicularly to the sides after the preliminary tension force is applied; and the tensioned shadow mask to which the main tension forces have been is fastened to a frame side of the support frame.

Hereinbelow, the manufacturing method will be described in detail based on the drawings after its outline is described.

(Shadow Mask)

The fundamental construction of the shadow mask is permitted to be similar to that of the normal shadow mask. The shadow mask is made of a metal material such as an INVER alloy Fe—Ni-alloy including Ni of 36% or iron. The shadow mask has a thickness of about 0.05 to 0.3 mm.

The shadow mask has an approximately rectangular external shape. A concrete dimensional configuration is set in accordance with the size and structure of a cathode ray tube to which the shadow mask is to be attached.

A perforation region provided with a number of minute holes through which an electron beam passes is provided in a center portion of the shadow mask. The arrangement configuration of the through holes is permitted to be similar to that of the normal shadow mask, and, for example, elongated through holes can be arranged in a staggered form.

Around the perforation region, a peripheral region that has no through hole in order to interrupt the passing of an electron beam is arranged in a frame-like shape along the periphery of the shadow mask. With regard to the width of the peripheral region, the width from the periphery of the support frame to the perforation region is normally set within a range of 5 mm to 50 mm, which may be changed depending on the conditions of the external shape dimensions and the required performance (and so on) of the shadow mask.

The shadow mask has an external shape that is one size larger than the external shape of the support frame before being attached to the support frame. Specifically, grip margins for fastening the shadow mask to the support frame in a tensioned state of the shadow mask are provided.

Therefore, the width of the aforementioned peripheral region is normally set within a range of 30 mm to 150 mm, which is wider than the width of the peripheral region of the shadow mask assembly in the completed state.

The longer sides that belong to the approximately rectangular shadow mask and principally receive tension forces when the shadow mask is fastened to the support frame are formed into linear shapes. However, each of the shorter sides can be provided with a curved recess portion that is gently curved in the corner portion. This curved recess portion is effective for reducing the uneven stress distribution in the plane of the shadow mask.

(Shadow Mask Assembly)

The shadow mask is supported in a flat state or an almost flat slightly curved state by fixing the peripheral sides of the outer periphery to the support frame in a tensioned state. The support frame is formed of shaped steel or the like in an approximately rectangular shape. The sides of the shadow mask are fixed to the upper end of the support frame by welding or the like.

An upper end surface of the support frame for supporting the shadow mask has an almost flat shapes. However, the surface can be provided with a slight curve. Specifically, the upper end surface that belongs to the support frame and is located on the longer side of the support frame can be curved so that the surface becomes high at the center and low on both sides along the lengthwise direction. The shadow mask is curved along the curve of the support frame. The radius of curvature of the slight curve of the support frame is, for example, about 10,000 mm, which may be changed depending on the screen size, characteristic, and the like.

The shadow mask may have its entire periphery fixed to the support frame. However, it is preferable to fix only the mutually opposite longer sides of the shadow mask to the support frame.

(Preliminary Tensioning Process)

A preliminary tension force is applied to each of the four corners of the shadow mask outwardly aslant (angled) with respect to the sides of the shadow mask. An angle in the slanting direction is set to 15 to 45(with respect to each side to which a main tension force is applied. The angle is preferably 20 to 35°. Depending on the angle at which the preliminary tension force is applied, the strength of the tension force components applied to the longer side and the shorter side of the shadow mask changes. In a main tensioning process, a tension force is normally applied in the direction of the longer side. Therefore, by applying a tension force having a certain component in the direction of the shorter side perpendicular to the direction of the longer side in a preliminary tensioning process, the occurrence of unevenness of the shadow mask, which cannot be canceled only through the main tensioning process, can be reduced. If the aforementioned angle is small (that is, less than 15°), then slackness tends to occur near the side perpendicular to the side to which the main tension force is applied. If the angle is too large (that is, over 45°), then slackness tends to occur on the side to which the main tension force is applied. Due to the occurrence of the above-mentioned slackness, the planarity of the shadow mask is impaired.

When fastening the tensioned shadow mask to the support frame by slightly curving the shadow mask, the direction of the preliminary tension force is set in accordance with the shape of the curve of the shadow mask. Specifically, the preliminary tension force can be applied in the above-described slanting direction in a plane of extension in which the surface of the shadow mask is extended in the tangential direction outwardly of the end portion.

The strength of the preliminary tension force is normally set to 9.8 N to 490 N or preferably 50 N to 490 N, which may be changed depending on the conditions of the material, thickness, dimensional configuration, and so on of the shadow mask. The preliminary tension force can be set to a ratio of 2% to 30% with respect to the main tension force described later. If the preliminary tension force is small (that is, less than 9.8N), then the effect of the present invention is not sufficiently achieved. If the preliminary tension force is excessively large (that is, over 490N), then a distortion occurs in the shadow mask, and this impairs the planarity through heat treatment in a subsequent process.

As a means or an apparatus for applying the preliminary tension force to the shadow mask, a means or apparatus used in manufacturing the normal shadow mask assembly can be used.

Specifically, a variety of clamp mechanisms, grip mechanisms, and tension mechanisms are adopted. For example, it is possible to hold the shadow mask between a pair of clamp members that have a stepped clench structure on mutually opposite surfaces and apply the preliminary tension force to the shadow mask by moving the clamp members.

It is also possible to provide an engagement structure for gripping the shadow mask at the four corners of the shadow mask. For example, an engagement hole may be formed in a through hole style. This engagement hole can be used for pulling an engagement pin or an engagement hook engaged with the engagement hole. The engagement hole preferably has a smooth shape that scarcely causes a local stress concentration when a tension force is applied. A circle is generally adopted, although, an oval shape or an ellipse shape can also be adopted. The engagement hole normally has a diameter of 3 mm to 8 mm, which may be changed depending on the strength of the applied tension force. With regard to the engagement hole, either only one hole or a plurality of holes can be formed at one corner portion of the shadow mask. If a tension force is applied by using a plurality of engagement holes, then the stress generated at each individual engagement hole is reduced, whereby damage to the engagement hole and local deformation of the shadow mask is difficult. The number of engagement holes to be provided can be set to three to eight holes per corner portion of the shadow mask.

The position in which the engagement hole is formed is permitted to be located where no influence is exerted on the performance of the shadow mask. The engagement hole is at least required to be arranged outside the perforation region. The engagement holes are preferably located in a position where the attachment of the tensioned shadow mask to the support frame is not disturbed. Specifically, the position is preferably located at the four corners of the shadow mask within a range of not smaller than 3 mm inside the side end of the shorter side to an extension line of the corresponding peripheral side of the perforation region, and within a range of the side end of the longer side to an extension line of the corresponding peripheral side of the perforation region. If the engagement hole is formed in a position excessively close to the side end of the shadow mask, then an edge portion of the engagement hole will be unfavorably broken or excessively deformed by stress concentration.

If the four corners of the shadow mask are directly clamped without providing the engagement hole, then the shadow mask can be clamped within a region surrounded by both sides and the extension lines of the peripheral sides of the perforation region.

The preliminary tensioning process is maintained for a specified time in a state in which a specified tension force is applied to the shadow mask. It is proper that the shadow mask is entirely elastically deformed or the stress distribution is uniform and stabilized.

(Main Tensioning Process)

Subsequent to the preliminary tensioning process, a main tensioning process is performed. According to the main tensioning process, a main tension force is outwardly applied to each of at least a pair of mutually opposite sides of the shadow mask in a direction perpendicular to the sides. The sides to which the main tension forces are applied are normally the longer sides. Each of the main tension forces is applied with a uniform strength sufficient for the whole body of the shadow mask or at least for the perforation region With regard to a device or a mechanism for applying the main tension forces, a technique similar to that of the aforementioned preliminary tensioning process can be adopted. The engagement hole, the clamp mechanism or the like can be adopted.

When fastening the tensioned shadow mask in a curved state to the support frame, it is preferable to apply the main tension forces in the same curved state as in fastening the tensioned shadow mask to the support frame. Therefore, a mechanism that can apply the main tension forces to the shadow mask while gripping the shadow mask in the curved state can be adopted.

The strength of the main tension force is normally 980 N to 9800 N, which may be changed depending on the material and the dimensional configuration of the shadow mask.

The main tension forces can be further applied to the shadow mask in the state in which the preliminary tension forces have been applied through the preliminary tensioning process. After the application of the main tension forces to the shadow mask, the preliminary tension forces can be removed.

(Fastening Process)

The shadow mask to which the main tension forces are being applied is fastened to the frame sides of the support frame. A fastening means and processing conditions can be similar to those in assembling a normal shadow mask assembly. Normally, the shadow mask is fixed to the support frame by performing welding in a state in which the shadow mask is superposed on the upper end of the frame side of the support frame.

After fastening the shadow mask to the support frame, the preliminary tension forces and the main tension forces are released and pressing forces to the support frame are also released. Thereafter, an unnecessary portion that belongs to the shadow mask and is protruding from the support frame can be cut and removed. As one example, the longer side portions of the shadow mask outwardly protruded from the support frame are cut and removed while the shorter side portions thereof themselves are used.

Further, by way of necessary post-processing of a baking process and so on through heat treatment, a shadow mask assembly is completed.

(Support Frame Compressing Process)

Compression forces (that is, pressing forces) for distortion can be preliminarily applied to the support frame to which the tensioned shadow mask is to be fastened. That is, compression forces are applied in a direction in which the interval between the frame sides is narrowed to a pair of mutually opposite frame sides corresponding to the sides of the shadow mask to which the main tension forces are applied among the frame sides of the support frame.

The shadow mask to which the tension forces have been applied through the preliminary tensioning process and the main tensioning process is fastened in the tensioned state to the frame sides of the support frame into which the compression forces have been applied.

In the tensioned and fastened state, the shadow mask tries to contract to the original size, while the support frame tries to expand to the original size. Both the members are stabilized in a state in which they are balanced (i.e., in a state in which compression stresses generated in the shadow mask and tension stresses generated in the support frame counterbalance each other). As a result, a residual stress of a sufficient strength exists in the tensional direction. If the shadow mask assembly is subjected to heat treatment in the post-processing, then the shadow mask tries to expand. However, the effect of the tensional residual stress is consistent, and this suppresses the local extension of the shadow mask and prevents the occurrence of undulations or unevenness.

In order to merely increase the residual stress in the tensional direction occurring in the shadow mask, it is acceptable to only increase the main tension forces applied in the main tensioning process. However, in order to apply large main tension forces, the device for the purpose has an increased scale. If an excessive main tension force is applied to the shadow mask, then there is an issue that a permanent deformation would be locally generated. By preliminarily compressing the support frame, an appropriate residual stress can be generated in the shadow mask without causing such an issue.

The strength of each of the compression forces to be applied to the support frame can be normally set within a range of 100 N to 15000 N, which may be changed depending on the magnitude of each of the main tension forces applied to the shadow mask.

(Cathode Ray Tube)

The cathode ray tube to be assembled with the shadow mask assembly of the present embodiment has a structure similar to that of the normal cathode ray tube.

The structure of the general cathode ray tube includes a flared tube body made of glass or the like, an electron gun that is attached to the root portion of the tube body and irradiates an electron beam, and a front panel that is attached to the fore end of the tube body and internally has a fluorescent surface for emitting light upon receiving an electron beam applied thereto. The front panel is also made of a transparent material such as glass. Around the root portion of the tube body of the cathode ray tube is provided a deflection yoke for scanning the electron beam by a magnetic field to be generated The shadow mask assembly constructed of the shadow mask and the support frame is attached to the inside of the front panel. The shadow mask assembly is fixed to the periphery of the support frame inside the front panel via plate-segment-like clamps, shafts, bolts, and so on. By thus connecting to the tube body the front panel to which the shadow mask assembly is attached, a cathode ray tube can be obtained. The cathode ray tube is internally conditioned to a vacuum or a specified gaseous environment.

The cathode ray tube is assembled into an image display device such as a television receiver. The image display device is provided with a control circuit for controlling the operations of the electron gun of the cathode ray tube, the deflection yoke mounted on the periphery of the cathode ray tube, and so on. As the need arises, an operation panel for image control-use is provided. The television receiver can be provided with an input section of an image signal or an audio signal, a tuner section for selecting a signal, a loudspeaker for generating sound, and so on.

Hereinbelow, the method of manufacturing the shadow mask assembly will be described in detail based on FIGS. 1–10.

(Overall Structure of Shadow Mask)

Figure 2:
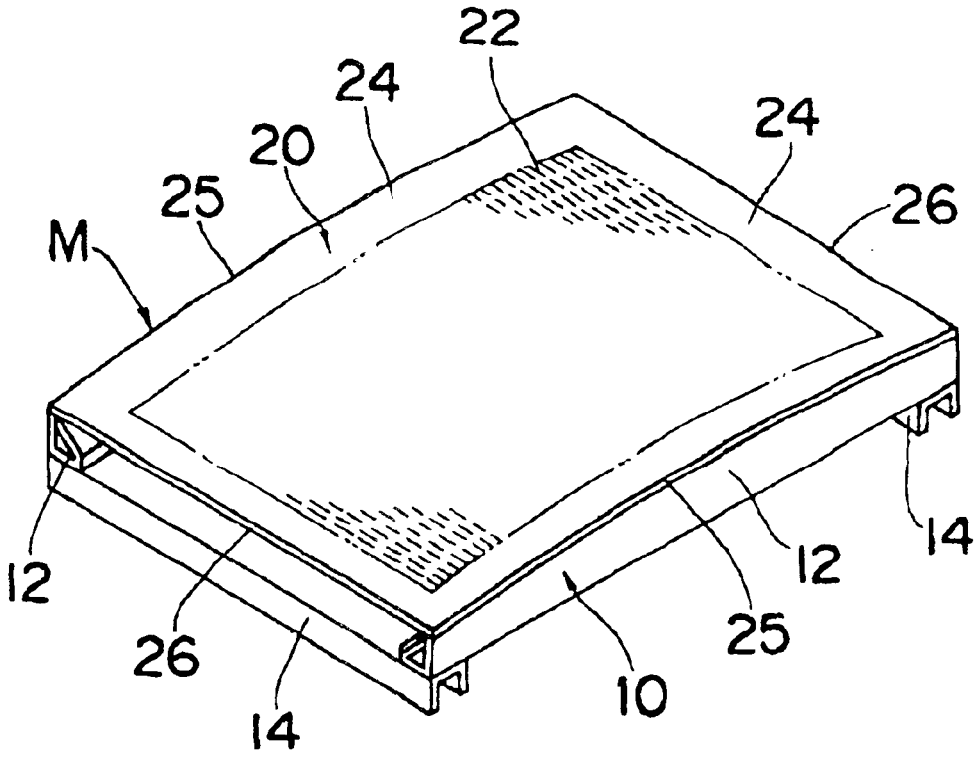
FIG. 2 is a perspective view of an assembled shadow mask assembly in the shadow mask assembly manufacturing method.

FIG. 1 shows a shadow mask before being attached to a support frame in the method of manufacturing the shadow mask assembly according to the embodiment of the present invention, while FIG. 2 shows the shadow mask assembly after before attached.

As shown in FIG. 1, the shadow mask 20 is made of an INVER alloy and formed so as to have a rectangular flat sheet-like shape. The shadow mask 20 has a thickness of 0.1 mm. A rectangular perforation region 22 is arranged in a center portion of the shadow mask 20. The perforation region 22 is provided with through holes 23, which are minute elongated holes that penetrate from the front surface to the rear surface of shadow mask 20.

The shadow mask 20 has a frame-shaped peripheral region 24 arranged outside the perforation region 22. The peripheral region 24 is provided with no through holes.

With regard to the peripheral sides of the shadow mask 20, longitudinal sides 25 and 25 are linear, while the shorter sides 26 and 26 are linear at ends 26*a* and 26*a* near both sides and smoothly curved and recessed in the center portion forming a curved recess portion 27.

The support frame 10 is made of shaped steel, and a pair of longitudinal support members 12 and a pair of shorter side support members 14 are assembled in a parallel cross pattern. On the upper surface of each end of the pair of shorter side support members 14 are arranged only the mutually opposite longitudinal support members 12. The upper end surfaces of the longer side support frames 12 are slightly curved along the lengthwise direction with a raised center portion and lowered end portions.

The shadow mask 20 has its longer (longitudinal) sides fixed by welding to the upper ends of the longitudinal support members 12 so that the mutually opposite longer sides 25 are tensioned by being strongly pulled in an outward direction.

(Shadow Mask Assembly Manufacturing Work)

The shadow mask 20 is manufactured to have a structure with the aforementioned shape, and thereafter is subjected to a process for reducing the residual stress by forging and a melanization process with heating.

The support frame 10 is assembled in a frame shape by manufacturing the longitudinal support members 12 and the shorter side support members 14 by press working and A cutting, and thereafter bonding them together by welding or the like.

The method of manufacturing the shadow mask assembly and the method of manufacturing the cathode ray tube, according to an embodiment will be described based on FIG. 10.

Figure 10:
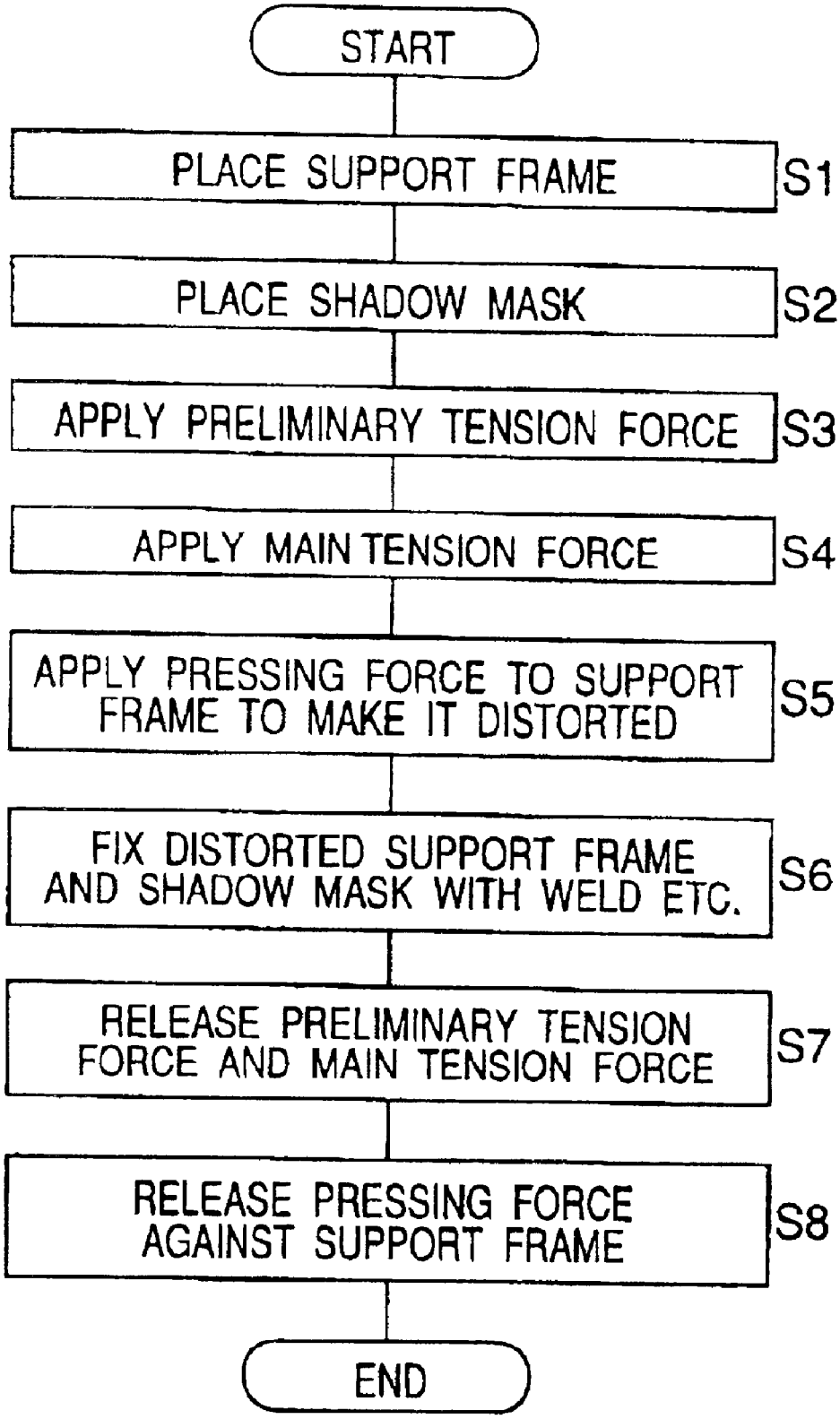
FIG. 10 is a flowchart of the method of manufacturing the shadow mask assembly.

First, as shown in FIG. 10, the support frame is positioned at step S1, and then the shadow mask 20 is placed thereon at step S2. Then, at step S3, the preliminary tension forces $P_2$ are applied to the shadow mask 20. Then, at step S4, the main tension forces P1, which are greater than the preliminary tension forces $P_2$, are applied to the shadow mask 20. Then, at step S5, pressing forces are applied to the support frame to distort the support frame. Then, at step S6, the distorted support frame and the tensioned shadow mask are fastened by welding or similar means. Then, at step S7, the preliminary tension forces $P_2$ and the main tension forces $P_1$ are released. Then, at step S8, the pressing forces to the support frame are released. Thus, the shadow mask assembly can be manufactured. As step S5, the process of applying the pressing forces to the support frame to distort it, in short, may be performed before the fastening process such as welding or the like at step S6 (that is, before step S2, S3, or S4). Hereinbelow, these steps S1–S8 will be described in detail.

(Preparing Process)

Firstly, after positioning the support frame 10 at step S1, the shadow mask 20 is placed on the support frame 10 at step S2.

Next, at steps S3 and S4, a specified tension is applied to the shadow mask 20. Then, in a state in which the support members 12 are distorted as shown by the one-dotted-chain line of FIG. 11 by pressing forces at step S5, at step S6, the shadow mask 20 is welded to the upper ends of the longer sides of the distorted support members 12.

Figure 11:
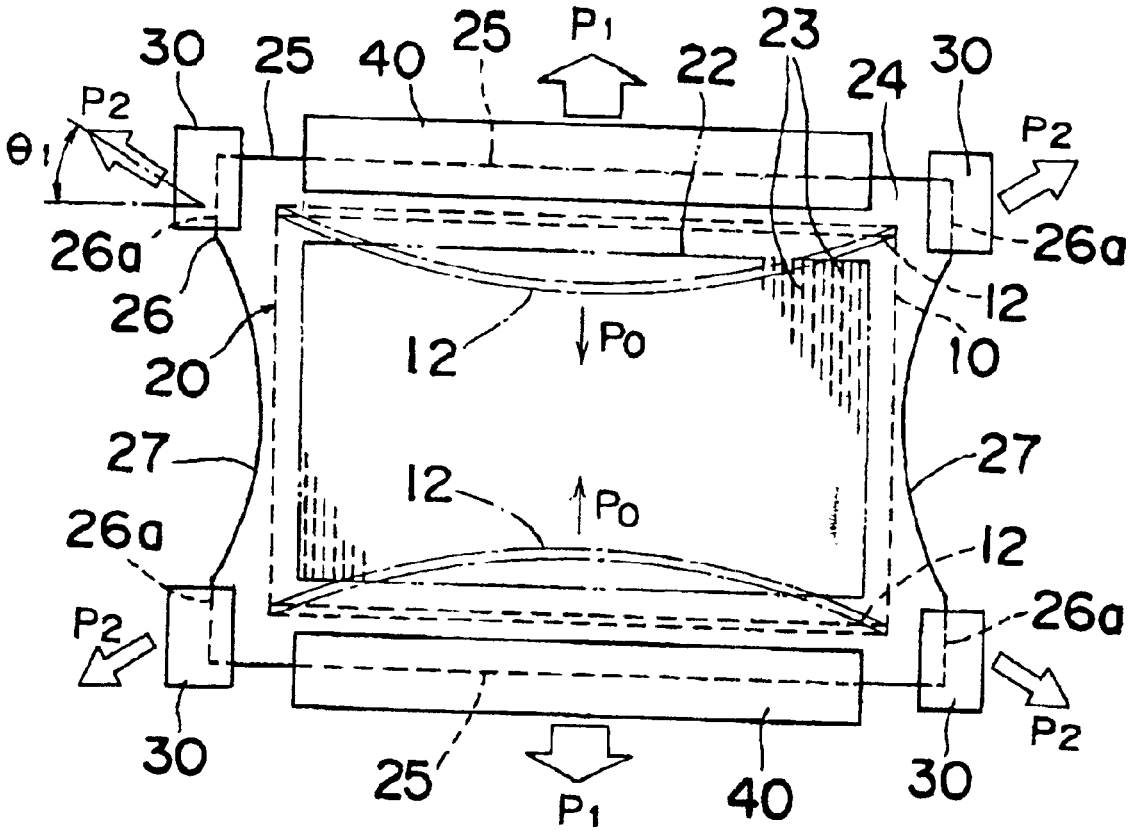
FIG. 11 is a plan view showing a tension process of the shadow mask and a distortion state of the support frame in the method of manufacturing the shadow mask assembly.

Here, a state in which the support members 12 is distorted as shown by the one-dotted-chain line of FIG. 11 by the pressing forces $P_0$ means the following. At step S5, the pressing forces (in other words, the compression forces) $P_0$ are primarily applied to the support frame 10 to which the tensioned shadow mask 20 is fastened. Thus, as shown by the one-dotted-chain line in FIG. 11, the pair of longitudinal sides of the support frame 10 are inwardly curved and distorted to each other. That is, the compression forces $P_0$ are applied in a direction in which the interval between the frame sides is narrowed to the pair of mutually opposite frame sides corresponding to the sides of the shadow mask to which the main tension forces $P_1$ are applied among the frame sides of the support frame as shown by the one-dotted-chain line in FIG. 11.

The shadow mask 20 to which the tension forces $P_2$ and $P_1$ have been applied through the preliminary tensioning process and the main tensioning process is fastened in the tensioned state to the frame members of the support frame 10 to which the compression forces $P_0$ have been applied. In the state in which the tensioned shadow mask 20 is fastened to the support frame 10, the shadow mask 20 tries to contract to its original size, while the support frame 10 tries to expand to its original size. Both members are stabilized in a state in which they are balanced (i.e., in a state in which compression stresses generated in the shadow mask 20 and tension stresses generated in the support frame 10 counterbalance each other). As a result, a residual stress having a sufficient magnitude exists in the tensional direction at the shadow mask 20. If the shadow mask assembly is subjected to heat treatment in the post-processing, then the shadow mask 20 tries to expand. However, the effects of the tensional residual stress are consistent, and this suppresses the local extension of the shadow mask 20 and prevents the occurrence of undulations or unevenness.

In order to merely increase the residual stress in the tensional direction occurring in the shadow mask 20, it is acceptable to only increase the main tension forces $P_1$ applied in the main tensioning process. However, in order to apply large main tension forces $P_1$, the device for the purpose has an increased scale. If an excessive main tension force $P_1$ is applied to the shadow mask 20, then there is a problem in that a permanent deformation would be locally generated. By preliminarily compressing the support frame 10, an appropriate residual stress can be generated in the shadow mask 20 without causing such an issue. The strength of each of the compression forces to be applied to the support frame 10 can be normally set within a range of 100 N to 15000 N, which may be changed depending on the strength of each of the main tension forces $P_1$ applied to the shadow mask 20.

Figure 3:
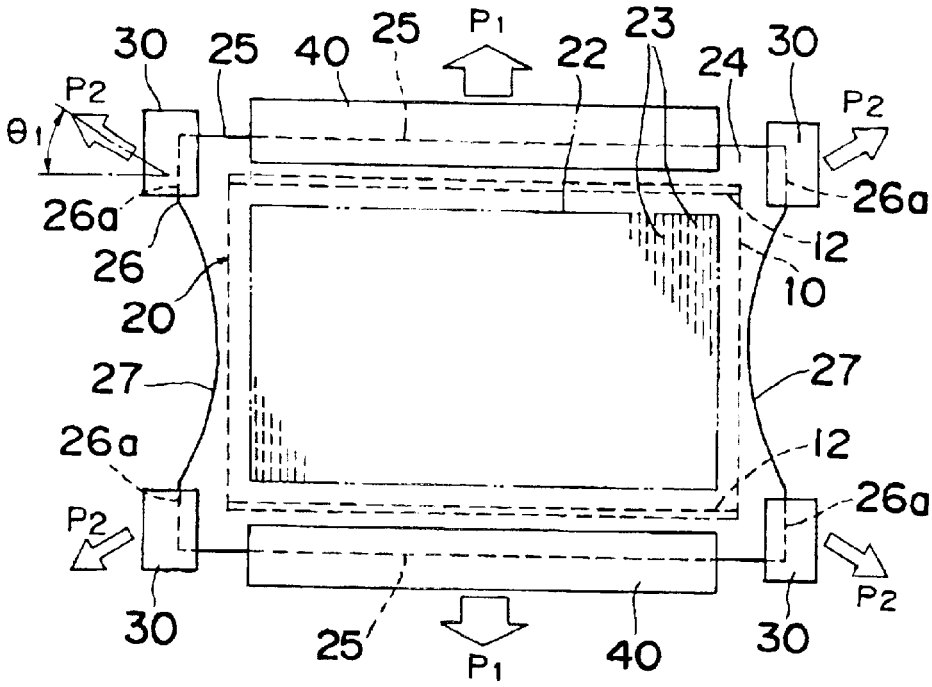
FIG. 3 is a plan view showing a tensioning process of the shadow mask in the shadow mask assembly manufacturing method.

As shown in FIG. 3, at steps S3 and S4, each of the tension forces applied to the shadow mask 20 are comprised of a main tension force $P_1$ for pulling the mutually opposite longer (longitudinal) sides 25 of the shadow mask 20 in order to apply a proper tension, and a preliminary tension force $P_2$ for pulling the four corners of the shadow mask 20 in the diagonal (inclined) direction relative to the sides of the shadow mask 20.

(Preliminary Tensioning Process)

At step S3, the preliminary tension force $P_2$ is applied to each of the four corners of the shadow mask 20 by four preliminary tensioning tools 30 before applying the main tension force $P_1$.

The preliminary tension force P2 is angled at an angle (1 with respect to the direction of the longer sides 25 of the shadow mask 20, and is applied outwardly in the slanting direction. The angle $\theta_1$ is set to be 15–45°, preferably 20–35°, with respect to the sides to which the main tension forces are applied.

Figure 4A:
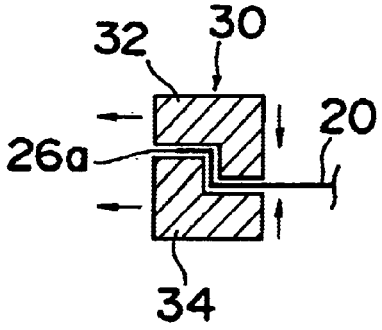
FIG. 4A is a sectional view showing a clamping portion of the shortened sides of the shadow mask.

As shown in detail in FIG. 4A, the tensioning tool 30 is constructed of a vertically arranged pair of pinch blocks 32 and 34. The pinch blocks 32 and 34 have stepped portions that are shaped counter to each other so as to clench each other. Part of the shadow mask 20 is pinched between the pinch blocks 32 and 34 and vertically pressed. By pulling the whole body of the tensioning tool 30 outwardly with respect to the shadow mask 20 in this state, a strong tension force can be applied to the shadow mask 20 in a state in which the shadow mask 20 is securely held.

Figure 4B:
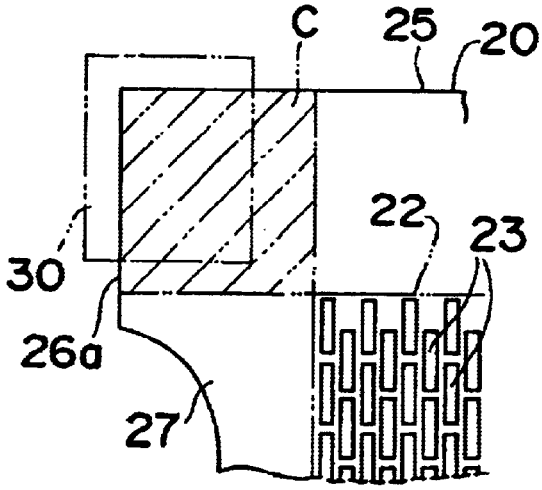
FIG. 4B is an enlarged plan view of the clamping portion.

The tensioning tool 30 pulls the shadow mask 20 by a portion that exerts no influence on the final performance of use. Specifically, as shown in FIG. 4B, a grip region C which the tensioning tool 30 can contact is set outside the perforation region 22 of the shadow mask 20. The grip region C is a rectangular region surrounded by shorter side 26 and the longer side 25 of the shadow mask 20 and the extension lines of both the longer side and the shorter side of the peripheral sides of the perforation region 22.

Figure 9:
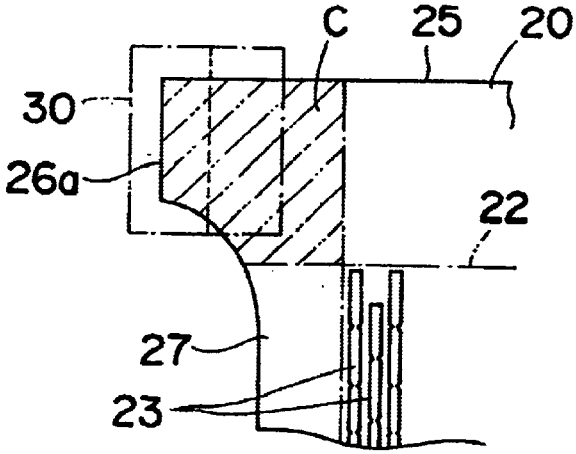
FIG. 9 is an enlarged plan view of a clamping portion of the shorter side of the shadow mask according to a modification.

The tensioning tool 30 preferably has a length capable of clamping the entire end 26*a* of the shorter side 26 of the shadow mask 20 as shown in FIG. 9 to scarcely cause wrinkles near the shorter side 26 of the shadow mask 20.

As shown in FIG. 3, in order to perform the preliminary tensioning process by the four tensioning tools 30 in a state in which the shadow mask 20 is arranged on the support frame 10, each tensioning tool 30 is required to be arranged outside the support frame 10. In this case, each tensioning tool 30 is arranged so as to be displaced toward the outside of the aforementioned grip region C.

The preliminary tension force $P_2$ applied to the four corners is required to pull the shadow mask 20 in a tangential direction in a direction of extension of the plane of the shadow mask 20. If the directions of the preliminary tension forces $P_2$ deviate, then the planarity of the shadow mask 20 is lost.

Figure 5:
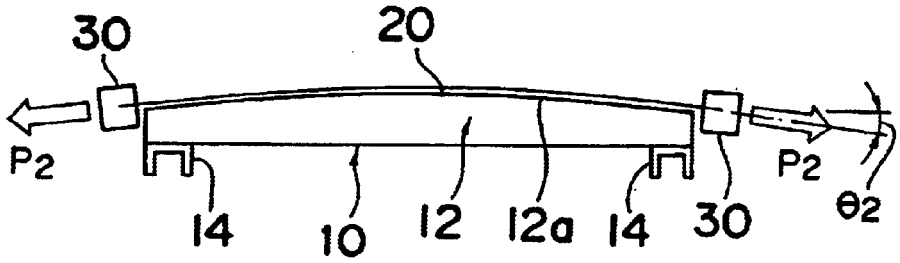
FIG. 5 is a side view of the tensioning process.

As shown in FIG. 5, if the shadow mask 20 is arranged along the longitudinal support member 12 of which the upper end is curved, then each preliminary tension force $P_2$ is applied slightly downward with respect to the horizontal direction. That is, the direction of each preliminary tension force $P_2$ is arranged within an extension plane of outward extension of the plane of the shadow mask 20 arranged along the longer side support frame 12. Each preliminary tension force $P_2$ has an angle (2 with respect to the horizontal direction.

Due to the four preliminary tension forces $P_2$, the shadow mask 20 tensioned along the slightly curved shape of the upper surface of the support frame 10 (i.e., the shape formed by the longitudinal support member 12). Each preliminary tension force $P_2$ applied to the shadow mask 20 includes both a longer side component and a shorter side component. Therefore, the shadow mask 20 is arranged in a tensioned state well balanced in all the planar directions.

<Main Tensioning Process>

As shown in FIG. 3, the shadow mask 20 in a state in which each preliminary tension force $P_2$ is applied is strongly pulled outward in a direction perpendicular to each longer side 25 by main tensioning tools 40 and 40 that grasp (clamp) the mutually opposite longer sides 25 along almost the full length, at least a range of the longer side 25 corresponds to the length of the perforation region 22, applying the main tension forces $P_1$ (at step S4).

Figure 8A:
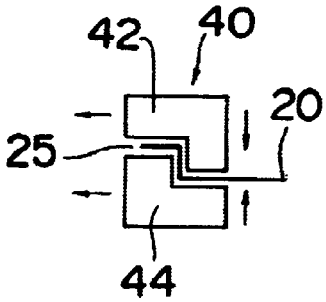
FIG. 8A is a sectional view showing a clamping portion of the longer side of the shadow mask.
Figure 8B:
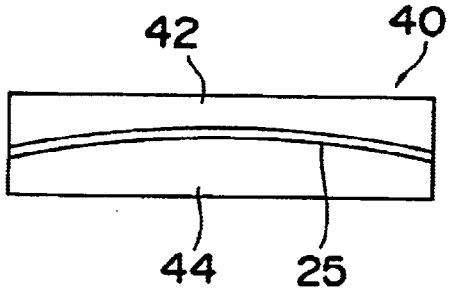
FIG. 8B is an enlarged plan view of the clamping portion.

The structure of the main tensioning tools 40 and 40 is similar to that of the preliminary tensioning tool 30 used in the aforementioned preliminary tensioning process as shown in FIGS. 8A and 8B. If the upper surface of the longitudinal support members 12 of the support frame 10 are curved and the shadow mask 20 is arranged in a curved state, then the tensioning tools 40 can preferably grip and pull the shadow mask 20 in the curved state. Therefore, the shapes of the tensioning tools 40 can be curved to correspond to the curved shape of the longitudinal support members 12 as shown in FIG. 8B. It is necessary for the tensioning tool 40 for the main tension force $P_1$ to have a width not less than the smallest width of the mask width of the shadow mask 20.

In the stage in which the main tension forces $P_1$ are applied by gripping the shadow mask 20 by the tensioning tools 40, the aforementioned preliminary tension forces $P_2$ are not required to be applied. Thus, the tensioning tools 30 may be removed.

With respect to the preliminary tension forces $P_2$ and the main tension forces $P_1$, after the preliminary tension forces $P_2$ are applied, the main tension forces $P_1$ are applied. The reason is that in order to apply the main tension forces $P_1$, it is necessary to increase the clamping portions for applying the main tension forces $P_1$, as compared with the clamping portions for applying the preliminary tension forces $P_2$. In a case where the shadow mask 20 is not tensioned by the preliminary tension forces $P_2$, the clamping for the main tension forces $P_1$ might be performed while a cause of wrinkles is present. Thus, the occurrence of wrinkles or streak-shaped unevenness can not be completely removed from the shadow mask. In contrast, the preliminary tension forces $P_2$ are first applied to the shadow mask to form a state in which the shadow mask 20 has no wrinkles. In such a state, the clamping is performed for the main tension forces $P_1$. As a result, the clamping for the main tension forces $P_1$ can be performed without a cause of wrinkles being present inside the shadow mask. Thus, the occurrence of wrinkles or streak-shaped unevenness can be effectively removed at the shadow mask.

The shadow mask 20 is supported in the tensioned state while being curved along the upper surface of the longitudinal support members 12 of the support frame 10. In this state, the shadow mask 20 is fixed by welding to the longitudinal support members 12 (step S6).

If the shadow mask 20 is fixed to the support frame 10, then the main tension forces $P_1$ applied by the tensioning tools 40 may be removed. That is, after the tensioned shadow mask 20 is attached to the support frame 10, the effects of the preliminary tension forces $P_2$ and the main tension forces $P_1$ are released at step S7, and the pressing forces to the support frame 10 are released at step S8.

The shadow mask assembly obtained by fastening the shadow mask 20 to the tensioned support frame 10 is subsequently subjected to necessary post-processing of a baking process with heat treatment, a process for cutting and removing a portion that belongs to the shadow mask 20 and is located outside the support frame 10, and so on, completing the shadow mask assembly.

The shadow mask 20 that has been brought in the satisfactory tensioned state through the preliminary tensioning process and the main tensioning process and fastened to the support frame 10 is prevented from having a degraded surface smoothness due to the occurrence of undulations or wrinkles even when subjected to heating or the like during the post-processing.

(Manufacturing of Cathode Ray Tube)

Figure 6:
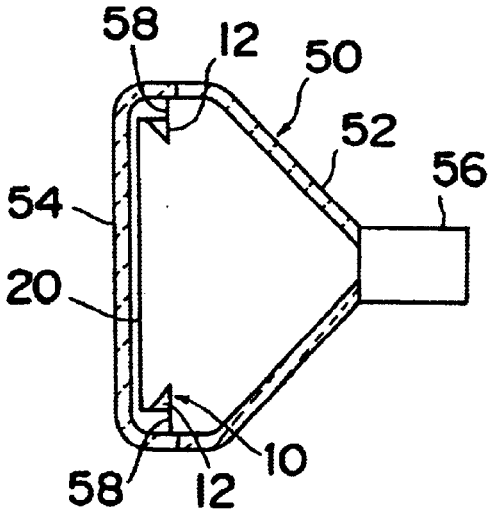
FIG. 6 is a sectional view of a cathode ray tube with the shadow mask assembly incorporated therein.

FIG. 6 shows a cathode ray tube employing the shadow mask assembly of the aforementioned embodiment.

A cathode ray tube 50 is constructed of a flared tube body 52 and a transparent front panel 54 that closes the opening portion located at the fore end of the tube body 52. The front surface of the front panel 54 is almost flattened, meaning that this cathode ray tube 50 is a flat-type television tube. The tube body 52 has at its root portion a control section 56 provided with an electron gun for irradiating an electron beam.

A fluorescent layer that emits light upon receiving an electron beam is formed (not shown) on the internal surface of the front panel 54, and the shadow mask assembly constructed of the shadow mask 20 attached to the support frame 10 is arranged on the back of the fluorescent layer. The electron beam irradiated from the control section 56 passes through the through holes 23 of the shadow mask 20 and collides against the fluorescent layer of the front panel 54 to emit light, thereby displaying an image. The shadow mask assembly is fixed to the inner peripheral surface of the front panel 54 by the outer periphery of the support frame 10 via a metal attachment member 58.

The cathode ray tube 50 is mounted with a deflection yoke arranged around the peripheral surface of the root portion thereof, and is assembled into an image display device such as a television receiver. The television receiver is also assembled with a control circuit section for controlling the operation of the cathode ray tube 50, a receiving section and a tuning section for receiving a television signal, a loudspeaker, and so on, in addition to the cathode ray tube 50.

(Tensioning by Engagement Holes)

Figure 7A:
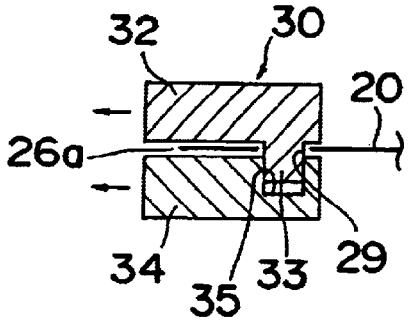
FIG. 7A is a sectional view showing the clamping portion according to another embodiment.
Figure 7B:
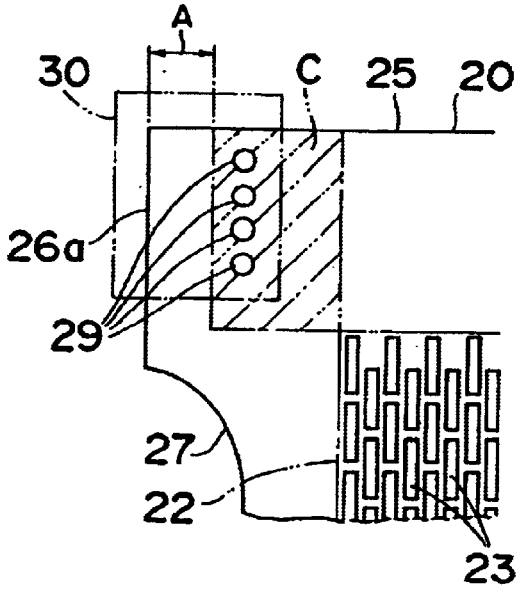
FIG. 7B is an enlarged plan view of the clamping portion.

In the embodiment shown in FIGS. 7A and 7B, the shadow mask 20 is provided with engagement holes, which is different than the structure of the shadow mask used with the tensioning tool 30 of the aforementioned first embodiment.

As shown in FIG. 7B, a plurality of engagement through holes 29 penetrate the shadow mask 20, and are formed side by side parallel to the shorter sides at the four corner portions of the shadow mask 20, In the tensioning tool 30 shown in FIG. 7A, an engagement pin 33 protrudes at a position and in a shape corresponding to each engagement hole 29 from one grip segment 32. The other grip segment 34 is provided with a reception hole 35 into which the engagement pin 33 is to be inserted. By inserting the engagement pins 33 of the tensioning tool 30 into the engagement holes 29 of the shadow mask 20, a tension force can be applied to the shadow mask 20 by the tensioning tool 30. No slip occurs between the tensioning tool 30 and the shadow mask 20 and, therefore, a strong tension force can be reliably applied.

In this case, a grip region C provided for the shadow mask 20 is set outside the extension lines of the outer peripheral sides of the perforation region 22, ranging to the peripheral sides to the longer side end and from the side end of the shorter side and to a distance A inside the shorter side edge of the shadow mask 20. The distance A can be set to, for example, 3 mm.

The shadow mask assembly manufacturing method of the present invention can prevent the occurrence of wrinkles and streak-shaped unevenness even when the shadow mask assembly is subjected to processing accompanied by expansion due to heating after being fastened to the support frame by preparatorily applying a preliminary tension force in the slanting (angled) direction to each of the four corners of the shadow mask. Thus, some tension is also applied in the direction perpendicular to the direction in which the main tension force is applied when performing the work of fastening the shadow mask to the support frame, with the main tension forces applied to the pair of mutually opposite sides of the shadow mask to achieve the tension state.

As a result, the cathode ray tube assembled with the shadow mask assembly is able to provide an improved image display quality and produce an excellent performance as an image display device.

The strength of the preliminary tension force $P_2$ may be set to be 9.8 N to 490 N, preferably 50 N–490 N, and can be set to a ratio of 2% to 30% with respect to the main tension force. If the preliminary tension force is small (that is, less than 9.8N), then the effect of the present invention is not sufficiently achieved. If the preliminary tension force is excessively large (that is, over 490N), then a distortion occurs in the shadow mask, and this impairs the planarity through heat treatment in a subsequent process. Therefore, when the strength of the preliminary tension force is 9.8 N to 490 N, the effect of the present invention can be sufficiently achieved and no distortion occurs in the shadow mask, and the preliminary tension force can be prevented from impairing the flatness through heat treatment in a subsequent process.

As one example, when the preliminary tension force is applied to each of the four corners of the shadow mask outwardly aslant with respect to the sides of the shadow mask, the angle in the slanting direction is set to 15 to 45(with respect to each side to which the main tension force is applied. The angle is preferably 20 to 35(. Depending on the angle at which the preliminary tension force is applied, the magnitude of the tension force components applied to the longer side and the shorter side of the shadow mask changes. In the main tensioning process, the tension force is normally applied in the direction of the longer side. Therefore, by applying the tension force having a certain component in the direction of the shorter side perpendicular to the direction of the longer side in the preliminary tensioning process, the occurrence of unevenness of the shadow mask, which cannot be canceled only through the main tensioning process, can be reduced. If the aforementioned angle is small and less than 15°, then slackness tends to occur near the side perpendicular to the side to which the main tension force is applied. If the angle is too large and over 45°, then slackness tends to occur on the side to which the main tension force is applied. Due to the occurrence of the above-mentioned slackness, the planarity of the shadow mark is impaired. Therefore, if the angle in the slanting direction is set to 15 to 45(with respect to each side to which the main tension force is applied, any slackness does not occur near the side perpendicular to the side to which the main tension force is applied, and the occurrence of unevenness of the shadow mask, which cannot be canceled only through the main tensioning process, can be reduced, and the planarity of the shadow mask is not impaired.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method of manufacturing a shadow mask assembly, comprising:

applying a preliminary tension force having a magnitude in a range of 9.8 N to 490 N to each of four corners of an approximately rectangular shadow mask, the shadow mask having a perforation region including a plurality of elongated through-holes and having a pair of opposing shorter sides, each of the shorter sides having a curved center recess section, the preliminary tension force being applied in an outward direction aslant with respect to each side of the shadow mask;

after said applying of the preliminary tension force, applying a main tension force to each of a pair of opposing sides of the shadow mask in an outward direction perpendicular to the opposing sides; and after said applying of the main tension force, fastening the shadow mask to side members of a support frame while the shadow mask is in the tensioned state, the support frame having an approximately rectangular shape.

2. The method of claim 1, further comprising:

before said fastening of the shadow mask, applying compression forces to a pair of opposing side members of the support frame, the pair of opposing side members corresponding to the pair of opposing sides of the shadow mask to which the main tension force is applied, the compression forces being applied in directions such that a gap between the pair of opposing side members is narrowed, said fastening of the shadow mask to the side members of the support frame being performed while the compression forces are applied to the support frame.

3. The method of claim 1, wherein the preliminary tension force is applied in a direction within a plane of the shadow mask extended outward from an end of the shadow mask in a tangential direction, and in a direction inclined at an angle in a range of 15 degrees to 45 degrees with respect to the pair of opposing sides of the shadow mask to which the main tension force is to be applied.

4. The method of claim 1, wherein said applying of the preliminary tension forces includes clamping the four corners of the shadow mask at a grip region located at each of the four corners, each grip region being bounded by both adjacent sides of the shadow mask and by extension lines of peripheral sides of the perforation region of the shadow mask.

5. The method of claim 1, wherein said applying of the preliminary tension forces includes placing engagement pins of a tensioning tool into engagement with engagement through-holes of the shadow mask located within a grip region at each of the four corners of the shadow mask, each grip region of the shadow mask having a quantity of 3 to 8 of the engagement through-holes, the grip region being defined by a first boundary line no less than 3 mm from the short-side edge of the shadow mask, a second boundary line extending from a peripheral side of the perforation region corresponding to the short-side edge of the shadow mask, a third boundary line along the long-side edge of the shadow mask, and a fourth boundary line extending from a peripheral side of the perforation region corresponding to the long-side edge of the shadow mask, each of the engagement through-holes having a diameter in a range of 3 mm to 8 mm.

6. The method of claim 1, wherein said applying of the main tension forces comprises applying each of the main tension forces to a portion of a range of the perforation region of the shadow mask.

7. The method of claim 1, wherein the main tension force is greater than the preliminary tension force.

8. The method of claim 7, wherein the main tension force has a magnitude in a range of 980 N to 9800 N.

9. The method of claim 1, wherein the preliminary tension force is applied in a direction inclined at an angle in a range of 15 degrees to 45 degrees with respect to the pair of opposing sides of the shadow mask to which the main tension force is to be applied.

10. A method of manufacturing a cathode ray tube, comprising:

manufacturing a shadow mask assembly by:

applying a preliminary tension force having a magnitude in a range of 9.8 N to 490 N to each of four corners of an approximately rectangular shadow mask, the shadow mask having a perforation region including a plurality of elongated through-holes and having a pair of opposing shorter sides, each of the shorter sides having a curved center recess section, the preliminary tension force being applied in an outward direction aslant with respect to each side of the shadow mask;

after said applying of the preliminary tension force, applying a main tension force to each of a pair of opposing sides of the shadow mask in an outward direction perpendicular to the opposing sides; and after said applying of the main tension force, fastening the shadow mask to side members of a support frame while the shadow mask is in the tensioned state, the support frame having an approximately rectangular shape;

installing the shadow mask assembly in a cathode ray tube, the cathode ray tube including a flared tube body, an electron gun attached to a root portion of the tube body, and a front panel having a fluorescent internal surface, the shadow mask assembly being attached to an inside portion of the front panel; and attaching the front panel having the shadow mask assembly attached thereto to a fore end of the tube body.

11. The method of claim 10, further comprising:

before said fastening of the shadow mask, applying compression forces to a pair of opposing side members of the support frame, the pair of opposing side members corresponding to the pair of opposing sides of the shadow mask to which the main tension force is applied, the compression forces being applied in directions such that a gap between the pair of opposing side members is narrowed, said fastening of the shadow mask to the side members of the support frame being performed while the compression forces are applied to the support frame.

12. The method of claim 10, wherein the preliminary tension force is applied in a direction within a plane of the shadow mask extended outward from an end of the shadow mask in a tangential direction, and in a direction inclined at an angle in a range of 15 degrees to 45 degrees with respect to the pair of opposing sides of the shadow mask to which the main tension force is to be applied.

13. The method of claim 10, wherein said applying of the preliminary tension forces includes clamping the four corners of the shadow mask at a grip region located at each of the four corners, each grip region being bounded by both adjacent sides of the shadow mask and by extension lines of peripheral sides of the perforation region of the shadow mask.

14. The method of claim 10, wherein said applying of the preliminary tension forces includes placing engagement pins of a tensioning tool into engagement with engagement through-holes of the shadow mask located within a grip region at each of the four corners of the shadow mask, each grip region of the shadow mask having a quantity of 3 to 8 of the engagement through-holes, the grip region being defined by a first boundary line no less than 3 mm from the short-side edge of the shadow mask, a second boundary line extending from a peripheral side of the perforation region corresponding to the short-side edge of the shadow mask, a third boundary line along the long-side edge of the shadow mask, and a fourth boundary line extending from a peripheral side of the perforation region corresponding to the long-side edge of the shadow mask, each of the engagement through-holes having a diameter in a range of 3 mm to 8 mm.

15. The method of claim 10, wherein said applying of the main tension forces comprises applying each of the main tension forces to a portion of a range of the perforation region of the shadow mask.

16. The method of claim 10, wherein the main tension force is greater than the preliminary tension force.

17. The method of claim 16, wherein the main tension force has a magnitude in a range of 980 N to 9800 N.

18. The method of claim 10, wherein the preliminary tension force is applied in a direction inclined at an angle in a range of 15 degrees to 45 degrees with respect to the pair of opposing sides of the shadow mask to which the main tension force is to be applied.

* * * * *